US005989054A

United States Patent [19]

Fasce

[11] Patent Number: 5,989,054

[45] Date of Patent: Nov. 23, 1999

[54] DEVICE FOR DETECTING CONNECTION OF WIRES IN A SOCKET

[75] Inventor: Xavier Fasce, Cluses, France

[73] Assignee: Pouyet S.A., Ivry sur Seine, France

[21] Appl. No.: 08/837,472

[22] Filed: Apr. 18, 1997

[30] Foreign Application Priority Data

May 2, 1996 [EP] European Pat. Off. ..... 96420149

[51] Int. Cl.[6] ..... H01R 4/24

[52] U.S. Cl. ..... 439/409; 439/358; 439/489

[58] Field of Search ..... 29/747, 748, 749, 29/752; 439/409, 488, 358

[56] References Cited

U.S. PATENT DOCUMENTS

| | | | |
|---|---|---|---|
| 4,148,138 | 4/1979 | Becker et al. | 29/749 |
| 4,282,644 | 8/1981 | Petree | 29/566.3 |
| 4,307,505 | 12/1981 | Jozens | 29/566.4 |
| 4,422,235 | 12/1983 | Becker et al. | 29/749 |
| 5,205,033 | 4/1993 | Drach | 29/749 |
| 5,568,686 | 10/1996 | Suarez | 29/749 X |
| 5,675,890 | 10/1997 | Yamamoto et al. | 439/409 |
| 5,855,491 | 1/1999 | Hintner et al. | 439/109 |

*Primary Examiner*—Lee Young
*Assistant Examiner*—Rick Kiltae Chang
*Attorney, Agent, or Firm*—Browdy and Neimark

[57] ABSTRACT

This invention relates to a method and device for reliably and positively connecting electric wires in receiving insulation-displacing slots. The pivoting connection pusher is closed by a locking catch borne by an elastic tongue and cooperating with a fixed closure stop. Locking is produced after passage of a hard point and provokes a clearly audible click which indicates to the installer that the insulation-displacing connection of the wire is then positively effected.

7 Claims, 3 Drawing Sheets

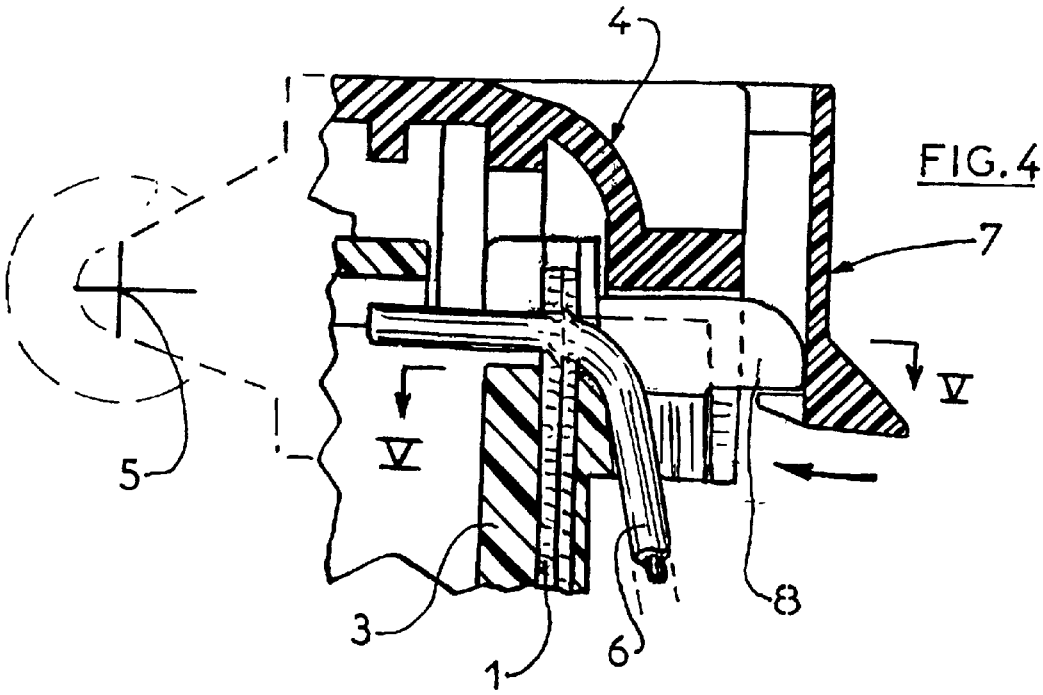
FIG. 4
FIG. 5
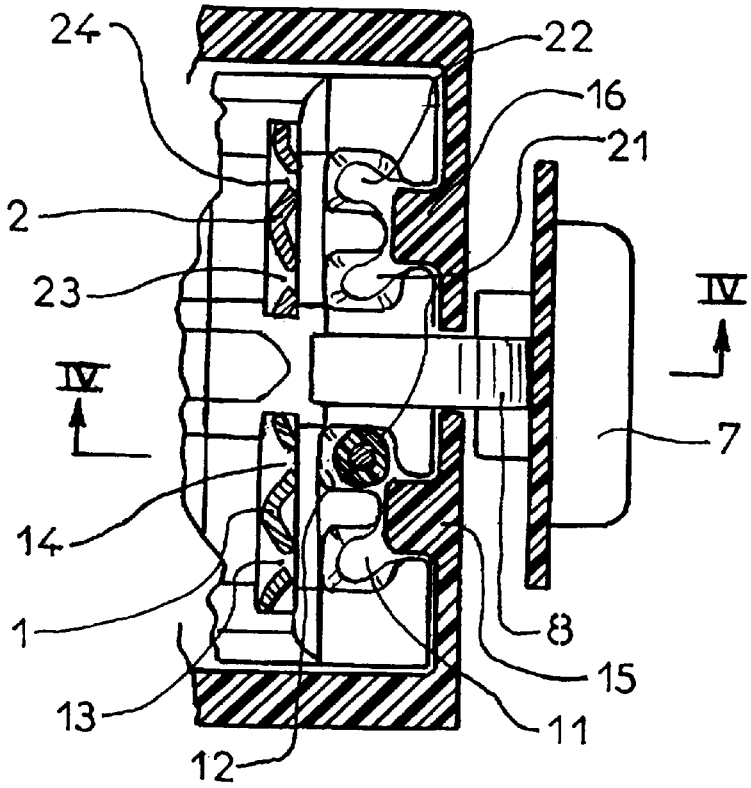

DEVICE FOR DETECTING CONNECTION OF WIRES IN A SOCKET

FIELD OF THE INVENTION

The present invention relates to a method and to a device for connection by insulation-displacing contacts.

BACKGROUND OF THE INVENTION

Rapid connections by contacts with insulation-displacing slots are now widely used in industry, in particular in the telephone- and computer-related connector technology industry.

U.S. Pat. No. 5,358,430 describes a female socket of the modular jack type with connections integrated therein. The modular jack contacts of the front opening of this socket are taken up at the rear on two series of insulation-displacing contacts. The connection of a wrapped telephone wire at the rear of the socket is then effected, without a special tool, by closure of two respective rotating covers which serve, to drive the wires in their respective receiving insulation-displacing slots, as rotating connection pushers.

This type of rotating pusher is very practical, but, in fact, it does not guarantee total operational reliability, as the installer is never absolutely certain that the connection is made. Out of a very large number of connections that he must effect every day, it may very well be that, for some of them, the rotating pusher has in fact not undergone a sufficient rotation and that, consequently, the corresponding wires are not correctly connected.

It is an object of the invention to overcome this drawback.

SUMMARY OF THE INVENTION

To that end, the present invention relates to a method for connection of wrapped wires by driving these wires in receiving insulation-displacing slots, by means of a rotating pusher of the pivoting cover type, characterized in that it consists in providing an elastic element which is fixed to the rotating pusher and which is stretched during rotation of this pusher for engagement of these wires in these slots, then which is suddenly released, at the end of stroke of this pusher, so that it violently hits the nose of a hard body which is prominent with respect to the means for holding the metallic contacts with insulation-displacing slots and which is fixed to this means, so as to obtain a clearly audible click which indicates to the installer that the insulation-displacing connection is positively effected, and whose sound intensity is at least equal to 45 decibels A.

This violent shock is advantageously created by the closure of a catch for locking this pusher at the end of stroke, this catch being taut in open position before release, and locking at the moment of its violent shock at the end of stroke.

The invention also relates to a device for carrying out this method, this device being characterized in that said connection pusher is a rotating pusher of the pivoting cover type, which comprises an elastic end-of-stroke locking catch, this catch cooperating with a fixed end-of-stroke locking stop and this locking stop cooperating with this catch to create a hard point of passage corresponding to a maximum tension of said catch and suddenly to release this catch in position of locking against the locking stop immediately after passage of this hard point, the sudden shock of the catch against its receiving part then producing said audible click.

BRIEF DESCRIPTION OF THE DRAWINGS

The invention will be more readily understood on reading the following description with reference to the accompanying drawings, in which:

FIGS. 2 to 4 show, in partial longitudinal section along IV—IV of FIG. 5, the successive phases of connection of this wire.

FIG. 5 is a view in horizontal section along V—V of FIG. 4.

DESCRIPTION OF PREFERRED EMBODIMENT

Figure 1:
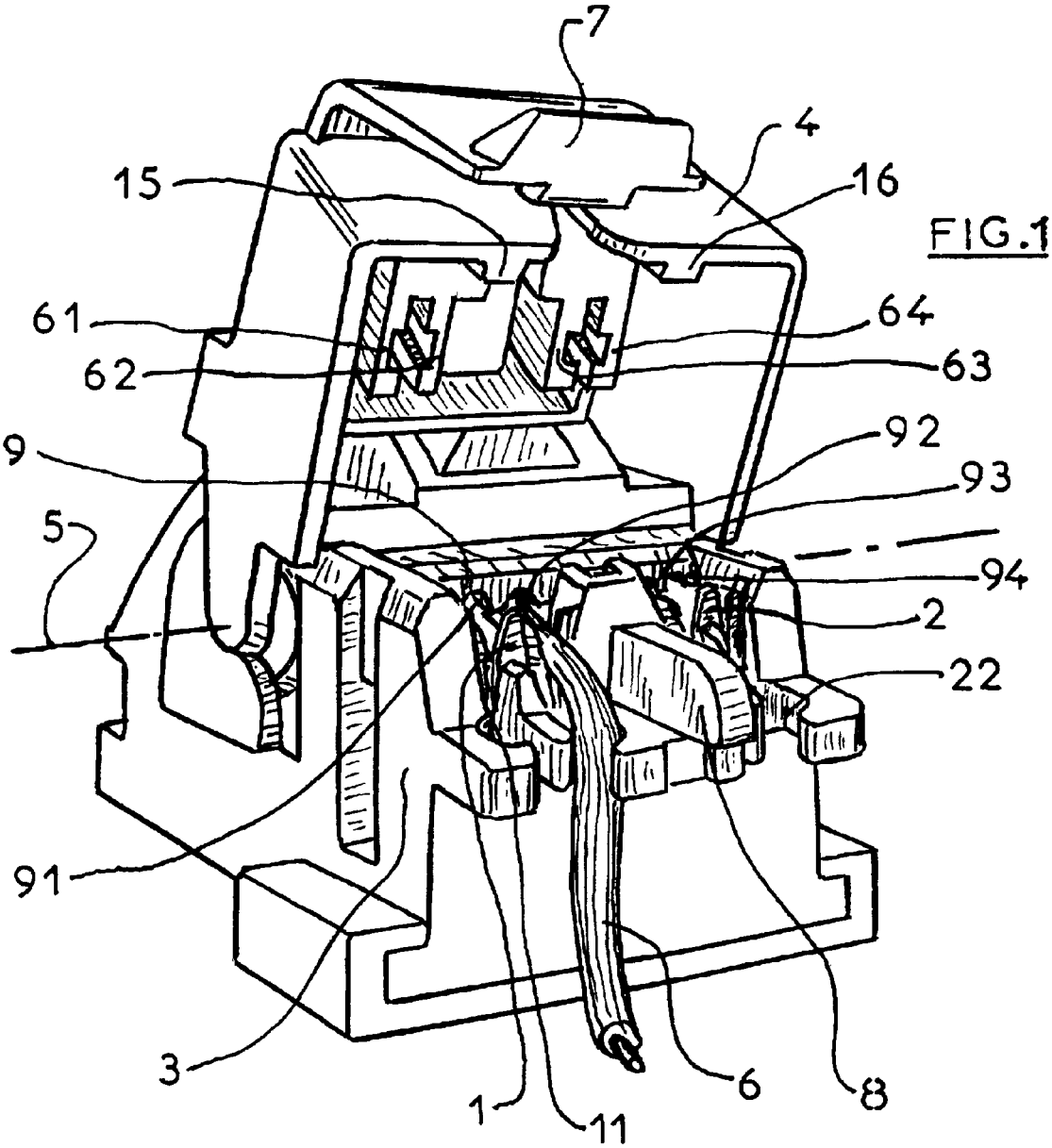
FIG. 1 is a view in perspective of the rear part of a telephone or computer socket, this rear part forming a device for connecting, by insulation-displacing contacts, telephone or computer lines with a wire ready to be connected and the connection pusher in open position.

Referring now to the drawings, FIGS. 1 and 5 shows the rear part of a monopair modular jack socket. This socket comprises two insulation-displacing metallic contacts 1, 2 which, in this embodiment, each comprise two insulation-displacing slots 13, 14, and 23, 24, as is the case for those described in U.S. Pat. No. 5,358,430 mentioned hereinabove.

Figure 2:
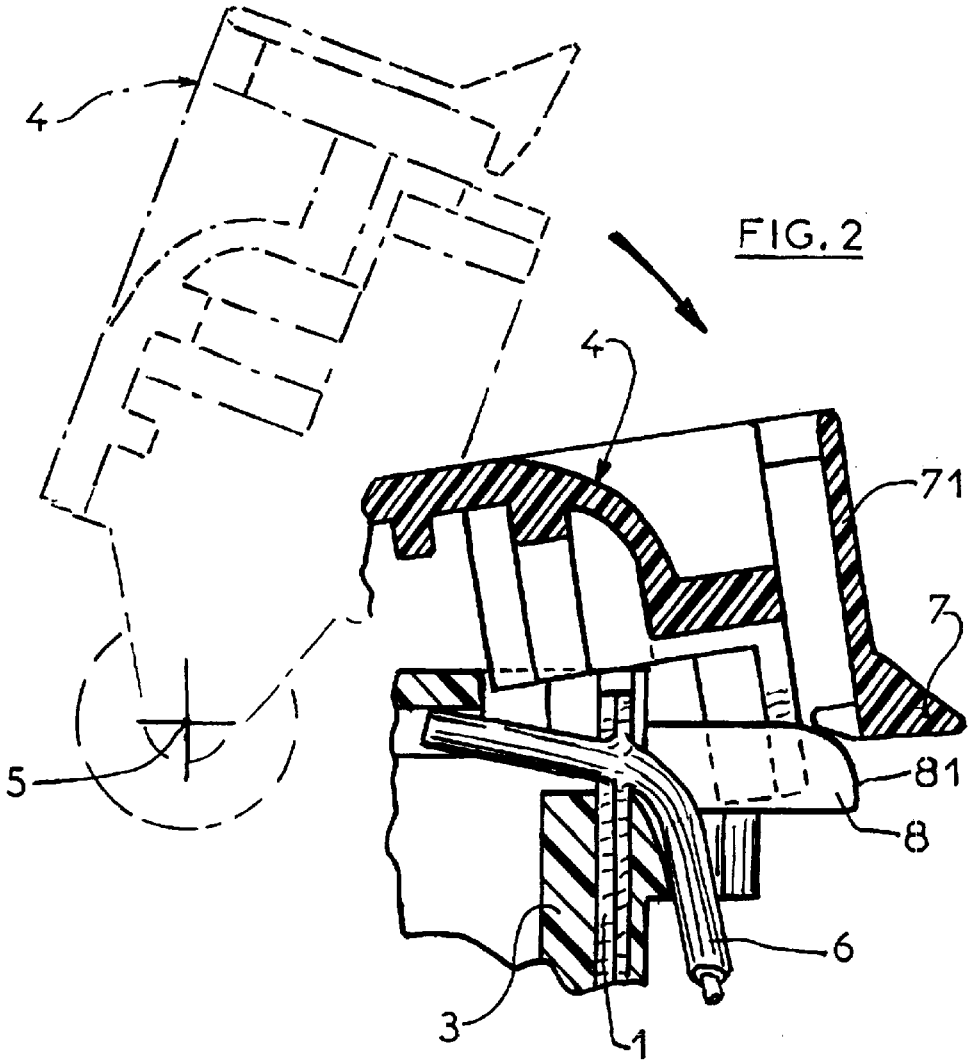

As is more readily seen in FIG. 2, these two insulation-displacing metallic contacts 1, 2 are each constituted by two thicknesses of metal and are maintained in the rear plastic body 3 of the socket. These insulation-displacing contacts may, of course, each be constituted by a single thickness of metal.

Like the one of U.S. Pat. No. 5,358,430, this socket presents a rotating connection pusher 4 made of plastics material which is in the form of a pivoting cover, this pusher 4 rotating about an axis 5 parallel to the row of insulation-displacing contacts 1, 2.

In FIG. 1, the two pairs of pusher-blades 61, 62 and 63, 64 are clearly distinguished, which, when the pivoting cover will be closed, will drive the wires to be connected in their receiving insulation-displacing slots 13, 14 and 23, 24 of metallic contact 1 and metallic contact 2, respectively.

By way of illustration, FIG. 1 shows a wrapped telephone wire 6 which is placed in position in the contact 1, at the inlet of its second insulation-displacing slot, and which is therefore ready to be connected by closure of the rotating connection pusher 4.

According to the invention, the pivoting cover, or rotating pusher 4 comprises an elastic end-of-stroke locking catch 7, this catch 7 cooperating with a fixed end-of-stroke locking stop 8. This stop 8 is formed by a prominent beak made of plastics material, which forms part of the body 3 and is obtained by moulding therewith.

As will now be shown with reference to FIGS. 2 to 5 which illustrate the functioning thereof in detail, the locking stop 8 cooperates, upon closure of the pivoting cover 4, with the elastic catch 7 to create a hard point of passage which corresponds to a maximum tension of this catch and, immediately after passage of this hard point, suddenly to release this catch 7 against the nose of the stop 8, producing a clearly audible click which then indicates to the installer that the insulation-displacing connection of the wire 6 is effectively and positively made with absolute certainty.

FIG. 2 shows the pivoting cover 4 at the beginning of the phase of closure. At this stage, the elastic catch 7 just rests, without tension, on the base of the convex ramp 81 which is formed at the front of the stop 8 to receive and push this elastic catch 7 progressively rearwards. The elasticity of the latter is due to the fact that it is borne by the free end of a tongue 71 made of plastics material of which the other end is fixed to the pivoting cover 4. At this stage, the pusher-blade 62 (FIG. 1) has not yet begun its action of driving the wire 6 in its receiving insulation-displacing slot 14 of the metallic contact 1.

Figure 3:
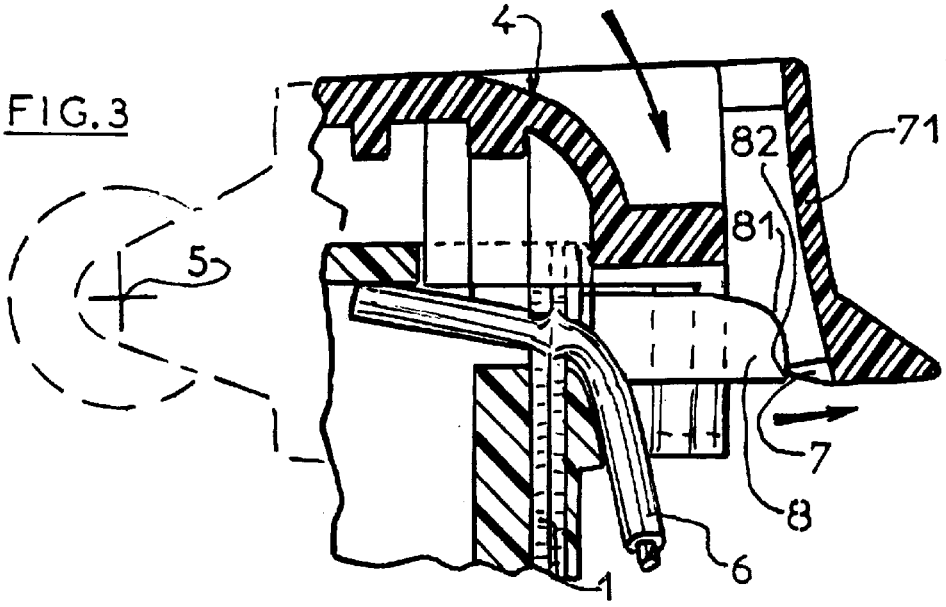

According to FIG. 3, by continuing the manual action of closure of the pivoting cover 4, the catch 7 is pushed rearwardly by the stop 8, along the convex ramp 81 thereof. The elastic tongue 71 is then curved, as shown, and is therefore subjected to a high elastic return tension. At this stage, the pusher-blade 62 begins to drive the wire 6 in its receiving insulation-displacing slot of the contact 1 and therefore to strip and connect the wire 6.

At the end of ramp 81, there is then passage of a hard point 82, then, according to FIG. 4, very brutal release of the elastic tongue 71 and locking of the pivoting cover 4 by clipping catch 7 on stop 8.

During this last phase, the pusher-blade 62 causes total and positive insulation-displacing connection of this wire.

The sudden release of the tongue 71 after catch 7 passes the hard point 82 causes this tongue to strike the front face, i.e. the nose, of the stop 8, very violently. The violent shock of these two hard bodies then causes a clearly audible click which, in accordance with the result expected by the present invention, indicates to the installer that the insulation-displacing connection of the wire 6 is effected positively, therefore with absolute certainty.

It should be noted, as clearly shown in FIG. 5, that the positive locking of the cover 4 makes it possible to hold the wire 6 well in its position of connection, thanks in particular to a short vertical groove 12 for reception and hold of the wire 6 which is provided, opposite each insulation-displacing slot, in the body 3, as well as to a corresponding short projection 15 which is provided, on the inner face of the pivoting cover 4, to close this groove 12, performing the role of a lid therefor.

The intensity of the click thus produced upon closure of the cover 4 is typically at least equal to 45 decibels A.

It goes without saying that the invention is not limited to the embodiment which has just been described. For example, it is also applicable to sockets which, like the one according to U.S. Pat. No. 5,358,430 mentioned hereinabove, present a plurality of closure pushers instead of one. It is likewise applicable to devices provided with a non-pivoting connection pusher which is closed for example by translation and not by rotation. It is generally applied to the connector technology industry and therefore not solely to the domain of telephone or computer-related connector technology which has been mentioned here only by way of preferred but non-limiting example.

What is claimed is:

1. A device for connecting insulated wires to a connector, said device comprising a pusher cover;

a socket;

said pusher cover rotatably engaged on said socket;

metallic contacts located in said socket having insulation displacing slots;

said pusher cover having at least one projection to drive at least one wire of said wires into a corresponding slot of said insulation displacing slots when rotated to a closed position on said socket;

said pusher cover having an elastic tongue having a free end;

said socket having a nose which projects out from a side of said socket;

a catch on said free end of said tongue slidably engaging a top side of said nose and bending said elastic tongue away from said socket during rotation of said pusher cover towards said closed position;

wherein when said pusher cover reaches said closed position and engages said wire in said slot, said catch disengages from the top side of said nose and said tongue is released to return to an unbent position and impact against said nose to produce an audible click.

2. The device according to claim 1, wherein in said closed position a first side of said catch is engaged to an underside of said nose.

3. The device according to claim 2, wherein the first side of said catch is substantially perpendicular a longitudinal length of to said tongue and parallel to the underside of said nose when in the closed position.

4. The device according to claim 1, wherein the top side of said nose is curved.

5. The device according to claim 4, wherein a second side of said catch which slidably engages said nose is formed at an acute angle to said tongue.

6. The device according to claim 5, wherein a maximum tension on the tongue is reached when said second side reaches an end of said curved top side.

7. The device according to claim 1, wherein the click has an intensity of at least equal to 45 decibels.

* * * * *